United States Patent [19]

Anderson

[11] Patent Number: 4,895,347

[45] Date of Patent: Jan. 23, 1990

[54] STARTING RAMP

[76] Inventor: Jerome J. Anderson, 20125 SW. Tualatin Valley Hwy., #2, 22A, Aloha, Oreg. 97006

[21] Appl. No.: 274,391

[22] Filed: Nov. 21, 1988

[51] Int. Cl.[4] ..... E02C 3/00

[52] U.S. Cl. ..... 254/88

[58] Field of Search ..... 254/88, 94; 280/762–763; 267/74

[56] References Cited

U.S. PATENT DOCUMENTS

| | | | |
|---|---|---|---|
| 3,018,494 | 1/1962 | Guido | 267/74 |
| 3,386,703 | 6/1968 | Thumma . | |
| 3,630,487 | 12/1971 | Wechter, Jr. . | |
| 3,784,161 | 1/1974 | Frese . | |
| 3,863,895 | 2/1975 | Grewe et al. . | |
| 3,915,430 | 10/1975 | Chromy et al. . | |
| 4,058,292 | 11/1977 | Goodrich et al. . | |
| 4,103,870 | 8/1978 | Murakami . | |
| 4,194,724 | 3/1980 | Masegian . | |
| 4,542,881 | 9/1985 | Naylor | 254/88 |

*Primary Examiner*—Robert C. Watson
*Attorney, Agent, or Firm*—Kolisch, Hartwell, & Dickinson

[57] ABSTRACT

A starting ramp assembly is intended for use with a wheeled vehicle for enhancing the starting ablility of the vehicle and for moving with the vehicle in a forward direction after the vehicle is clear thereof. The assembly includes a wedge-shaped ramp which has a generally rectangular ground-contacting base, including a frame which has plural, box-like regions formed therein. Plural base pads are mounted to the frame and are spring-biased to a position where the pads extend below the level of the base and provide a skid surface when the vehicle is clear of the ramp, the pads being shiftable upwards relative to the frame when the vehicle is on the ramp, providing a slip-resistant contact between the frame and the ground. The ramp includes an inclined, vehicle-support surface which extends upwards from one end of the base and an upright member extending between the other end of the base and vehicle-support surface. A length of chain is connected to the other end of the ramp and is attachable to the vehicle. A coil spring extends between a side of the ramp and the chain and provides direction orienting mechanism which is operable to direct the chain along a side of the ramp as the vehicle clears the ramp, causing end-for-end rotation of the ramp.

17 Claims, 2 Drawing Sheets

STARTING RAMP

BACKGROUND AND SUMMARY OF THE INVENTION

This invention pertains to starting ramps and particularly to a starting ramp which is used to enhance the starting ability of a vehicle, especially when the vehicle is pulling a trailer. A significant use for the ramp of the invention is in assisting a vehicle pulling a boat-laden trailer up a launch ramp.

The popularity of compact, light weight vehicles has grown in the past few years. The primary reason for such growth and popularity is the greater fuel economy of these smaller vehicles. However, the pulling ability of such vehicles is significantly less than that of full-sized, conventional vehicles. One situation in which the reduced pulling ability can cause significant problems is that in launching and recovery boats on inclined boat ramps. With conventional, full-sized vehicles, sufficient power and weight is available to recover a boat and pull the boat and trailer up an inclined launch ramp. The smaller vehicles suffer from decreased engine power and lighter weight which reduces traction both deficiencies combining to make boat recovery difficult.

An object of the invention is to provide a starting ramp which will enhance the starting ability of a vehicle on an inclined surface.

Another object of the invention is to provide a starting ramp which will travel with the vehicle/trailer combination once the vehicle has cleared the starting ramp.

A further object of the invention is to provide a starting ramp which will remain outboard of the wheel path of the vehicle and trailer once the vehicle is clear of the starting ramp.

Still another object of the invention is to provide a starting ramp which will smoothly glide on the inclined surface without damaging the starting ramp or the surface.

Another object of the invention is to provide a starting ramp which is collapsible and which may be set at more than one height.

Yet another object of the invention is to provide a starting ramp which is easy to manufacture and has a minimal number of components thereto.

The starting ramp of the invention is intended for use with a wheeled vehicle for enhancing the starting ability of the vehicle and for moving with the vehicle in a forward direction after the vehicle is clear thereof. The starting ramp includes a wedge-shaped ramp which has a generally rectangular ground-contacting base, including a frame which has plural, box-like regions formed thereon. Plural base pads are mounted to the frame and are spring-biased to a position where the pads extend below the level of the base and provide a skid surface when the vehicle is clear of the ramp, the pads being shiftable upwards relative to the frame when the vehicle is on the ramp, providing a slip-resistant contact between the frame and the ground. The ramp includes an inclined, vehicle-support surface which extends upwards from one end of the base and an upright member extending between the other end of the base and vehicle-support surface. A length of chain is connected to the other end of the ramp and is attachable to the vehicle. A coil spring extends between a side of the ramp and the chain and provides direction orienting mechanism which is operable to direct the chain along a side of the ramp as the vehicle clears the ramp, causing end-for-end rotation of the ramp.

These and other objects and advantages of the invention will become more fully apparent as the description which follows is read in conjunction with the drawings.

DETAILED DESCRIPTION OF A PREFERRED EMBODIMENT

Figure 1:
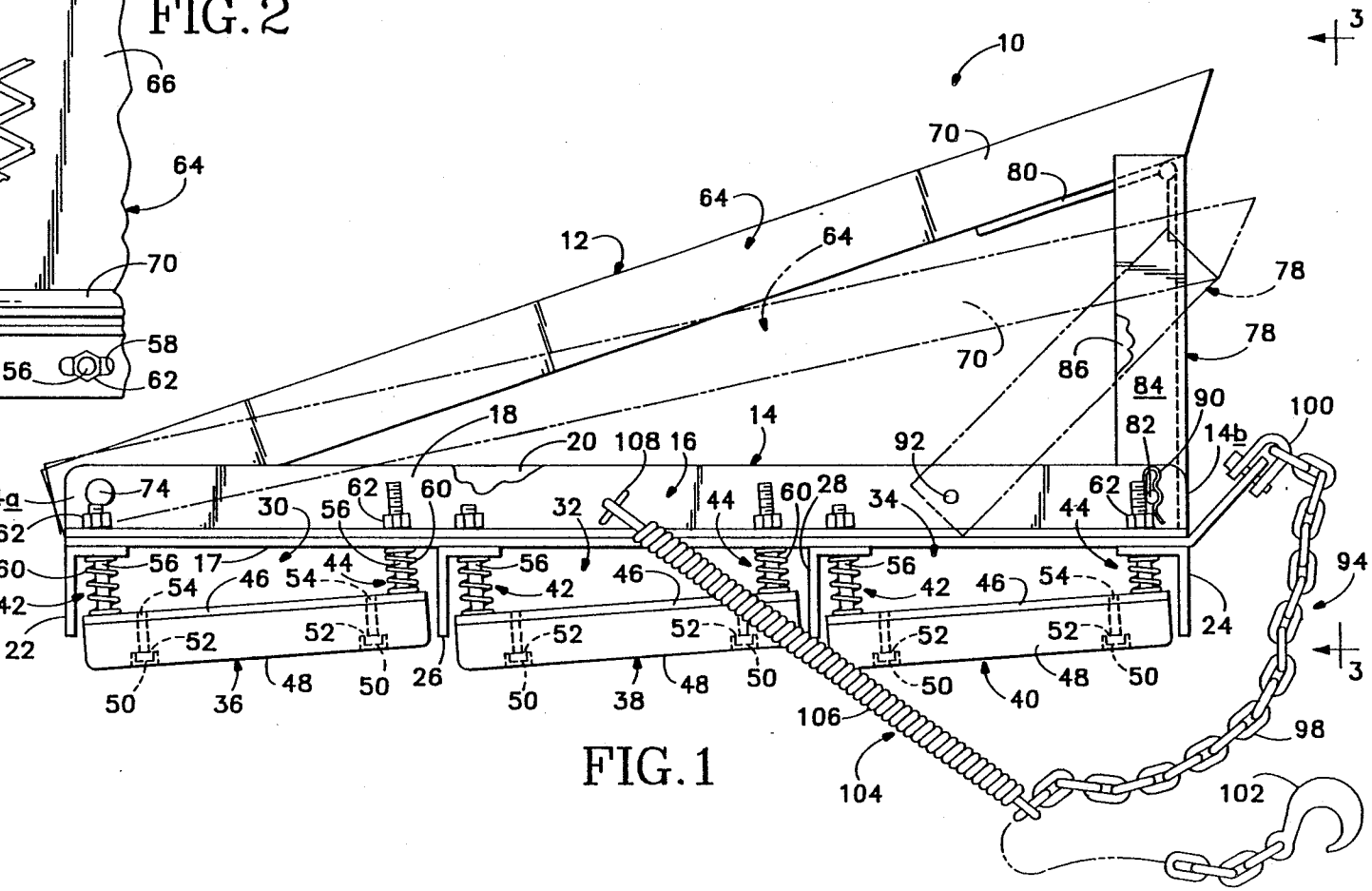
FIG. 1 is a side plan view of a starting ramp constructed according to the invention.

Referring now to the drawings, and initially to FIG. 1, a starting ramp assembly constructed according to the invention is shown generally at 10. Assembly 10 includes a wedge-shaped ramp 12 which has a ground-contacting base 14. Base 14 includes a generally rectangular frame 16 which, in the preferred embodiment, includes a plate 17 which has a pair of opposed, spaced apart sides 18, 20, secured to the top thereof, as by welding. An end 17*a* of plate 17 extends beyond the end of the ramp and is upturned at an angle of approximately 45° and provides an attachment point for connecting means, which will be described later herein. Opposed, spaced apart ends 22, 24 and cross pieces 26, 28 are secured to the bottom of plate 17 and extend between sides 18, 20 and form, along with the plate, sides and ends, plural, box-like regions 30, 32, 34 within frame 16. In the preferred embodiment, sides 18, 20, ends 22, 24 and cross pieces 26, 28 are formed of steel angle elements. Plate 17 and sides 18, 20 form which is referred to herein as a catch tray which will temporarily hold water and which provides strength to the base.

Base 14 also includes, in the preferred embodiment, three base pads 36, 38 and 40. The base pads are of identical construction and are mounted on frame 16 by spring-biased mountings, such as mountings 42, 44. Pads, and now referring to pad 36, include a plate 46 which is formed of a rigid material, which in the preferred embodiment is formed of steel. A pad element 48 may be secured to plate 46 by means of adhesive, vulcanization or by bolts 50 which are received in countersunk bores 52 formed in pad element 48. This arrangement provides that the heads of bolts 50 will not be subject to grinding action when the ramp is moved over a surface. Bolts 50 are received in tapped bores 54 formed in plate 46 to allow removal and/or replacement of pad elements on plate 46. In the preferred embodiment, pad element 48 is formed of styrene butadiene rubber which is approximately 1" thick and sized to fit on plate 46. The pad is both glued and bolted to the plate. The pad may be reversed after it has worn on a side thereof and eventually may easily be replaced.

Figure 2:
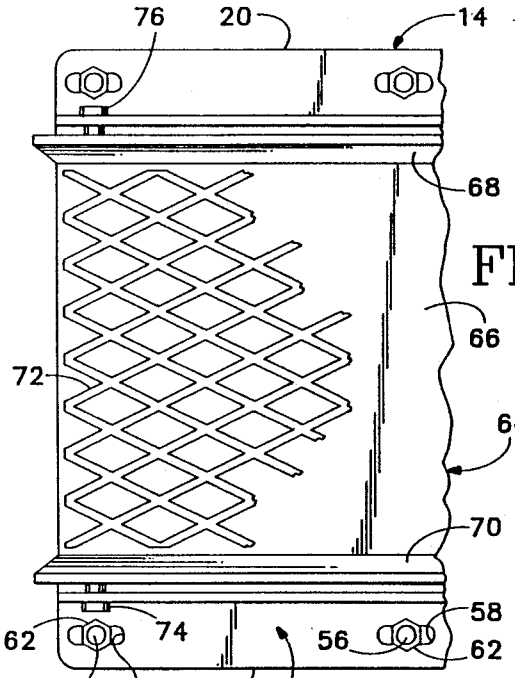
FIG. 2 is a top plan view of a portion of a vehicle-support surface of the invention.

Mounting means includes spring-biased mountings 42, 44. In the preferred embodiment, each mounting includes a threaded shaft 56 which is fixed to plate 46, as by welding, tapping, etc., and which extends through a slot 58 (FIG. 2) in sides 18, 20 of frame 16. A coil spring 60 surrounds a portion of shaft 56 between frame 16 and the base pad. A nut 62 is received on threaded shaft 56, thereby securing the base pad to the frame. In the case of mountings 42, nut 62 is located near the free end of threaded shaft 56. In the case of mountings 44, the nut is received a short distance from the free end of the shaft, thereby providing a slanted orientation to the base pad. Details of this feature will be described more fully later herein.

Ramp 12 includes an inclined vehicle-support surface 64 which extends upward from one end 14*a* of base 14. In the preferred embodiment, support surface 64 includes a rigid surface 66 which has upstanding sides 68, 70, which serve to prevent flexure of surface 66. In the preferred embodiment, an expanded metal gridwork 72 is fixed to surface 66 to increase frictional engagement between a vehicle tire and the ramp assembly. Support surface 64 is secured to base 14 by means of hinge pins or bolts 74, 76, which extend between sides 18, 20 and support surface sides 68, 70, respectively.

An upright member 78 extends between the other end 14*b* of base 14 and the other end of support surface 64. In the preferred embodiment, the upper end of upright member 78 is secured to support surface 64 by means of a hinge 80 which allows for folding of upright member relative to support surface 64 and collapsing of the ramp to a compact, carrying condition. The lower end of member 78 is secured to base 14 by means of a shaft 82 which extends through frame sides 18, 20 and flanges 84, 86 on member 78. Pin 82 has a curved, finger grip 88 at one end thereof and is maintained in its desired position by means of a cotter key 90 which extends through a bore in the other end thereof. A pair of pin-receiving bores are formed adjacent the other ends of sides 18, 20. A second set of pin-receiving bores, generally depicted at 92 are formed in sides 18, 20 several inches inboard of the end and may be used to secure the lower portion of upright member 78. With member 78 secured by a pin through bore set 92, as depicted in phantom lines, the height of support surface 64 is slightly reduced, thereby enabling the user to change the angle of the inclined vehicle-support surface.

The ramp assembly includes connecting means, shown generally at 94 for connecting the ramp to a vehicle 96 (FIG. 4) In the preferred embodiment, connecting means includes a length of chain 98 which is secured to the other end of ramp 12. A bore 99 is formed in end 17*a* of plate 17 and receives a clevis 100. Chain 98 is attached to clevis 100. The free end of chain 98 terminates in a hook 102.

Assembly 10 also includes direction orienting means, shown generally at 104 which in the preferred embodiment includes a plural spring 106 secured to an eye 108 fastened to a side of frame 16. The free end of spring 106 is attached intermediate the ends of chain 98. Direction orienting means is operable to provide directional control of the ramp after the vehicle is clear of the ramp in that it draws chain 98 to one side of the ramp, causing the ramp to turn end-for-end in a specific direction, as will be explained later herein.

Figure 4:
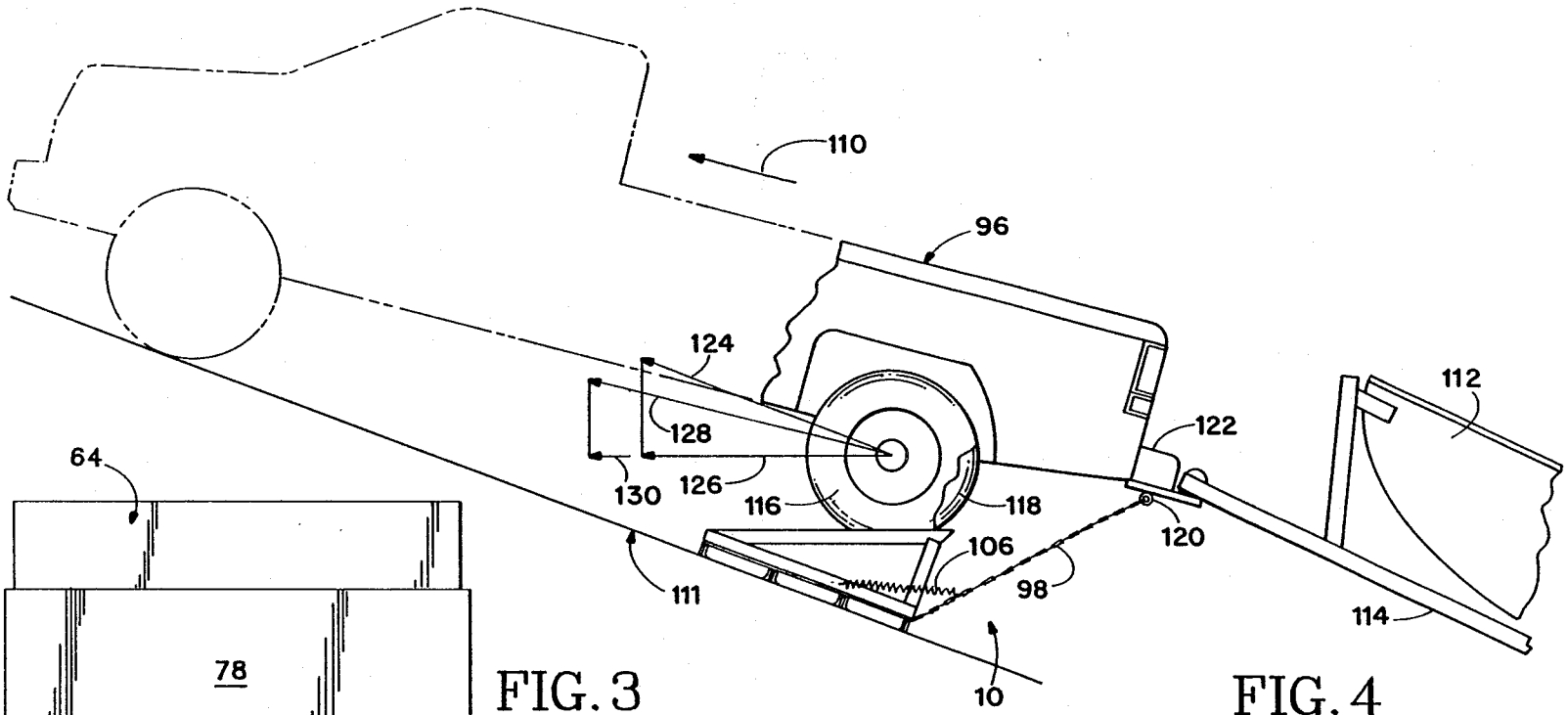
FIG. 4 is an environmental view of the ramp in use with a vehicle and a trailer.
Figure 3:
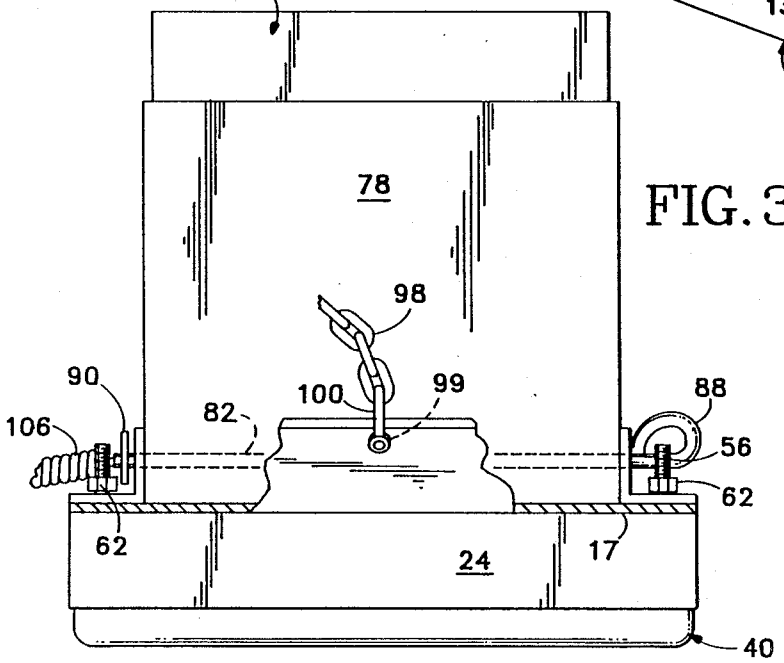
FIG. 3 is an end view of the starting ramp, taken generally along the 3—3 of FIG. 1.

Referring now to FIG. 4, operation of the starting ramp assembly of the invention will be described. The ramp assembly is intended to enhance the starting ability of a vehicle, such as vehicle 96 when the vehicle is attempting to start travel in a forward direction, as indicated by arrow 110 when the vehicle is on an incline, such as a boat launching ramp. The ramp assembly is used during the recovery operation when the vehicle is attempting to recover a boat 112 on a trailer 114. Although the sequence of steps to use the ramp assembly may be somewhat varied, the ramps are located behind the rear wheels 116, 118 of vehicle 96 and the hook 102 on each connecting means is secured to an eye 120 fixed at either side of the rear bumper 122 of the vehicle. The ramps will generally be positioned in the water. Chain 98 is sized to allow movement of vehicle 96 up support surface 64 until the rear wheels come adjacent the other end of the support surface, whereupon chain 98 will be taut and will retard further rearward movement of the vehicle on the ramp.

As the vehicle backs up the ramp, coil springs 60 are compressed and base pads 36, 38 and 40 are shifted upward relative to the frame, allowing the ramp to rest on ends 22, 24 and cross pieces 26, 28. Once the vehicle is clear of the ramp, spring 60 again extend, thereby positioning the base pads to a position where they extend below the level of the base, thereby providing a skidding surface. Boat 112 may be loaded on trailer 114 either before or after the vehicle is positioned on the starting ramp assembly.

As depicted in FIG. 4, use of the ramp assembly provides a lesser incline of vehicle 96 relative to a level datum thereby reducing the slope which the vehicle must climb. The forward thrust of vehicle 96 which is parallel to launch ramp 111 is represented by arrow 124. This would represent the thrust available from the rear wheels of the vehicle were assembly 10 not in place. Thrust 124 has a horizontal component 126. With the rear wheels of the vehicle located on ramp assembly 10, the forward thrust is represented by arrow 128 which has a horizontal component 130, which is greater than horizontal component 126, which translates into greater pulling power for vehicle 96.

As the vehicle starts forward, chain 98 slackens and is drawn to the outboard side of ramp 12 by spring 106. As the vehicle clears the ramp and continues in the direction of arrow 110, spring 106 draws chain 98 around the side of the ramp thereby causing end-for-end rotation of the ramp in a specific direction, i.e. in the direction toward the side of the ramp on which chain 98 is positioned by spring 106. The ramp then follows the vehicle forward in the direction of travel in a path which is outboard of the wheels of the vehicle and the trailer. End 17*a* of plate 17 is formed with an upward tilt of approximately 45° . This tilt provides somewhat of a lift to the end of the ramp as it is pulled behind the vehicle, helping the ramp to surmount obstacles in its path. Water and/or sand will be momentarily retained in the catch tray. The water and/or sand will spill from the tray as the ramps are pulled forward, and will act as a lubricant for the pads. Chain 98 is additionally sized such that the ramp will not interfere with the wheels of the trailer during forward motion. Base pads 36, 38 and 40 serve as skids, allowing the ramps to traverse what is usually a fairly rough or irregular surface. The incline of the pads toward the other end of the ramp enables the ramp to "rollover" small rocks or other obstacles.

Although a preferred embodiment of the invention has been disclosed herein, it should be appreciated that variations and modifications may be made thereto without departing from the scope of the invention as defined in the appended claims.

It is claimed and desired to secure as letters patent:

1. A starting ramp assembly for use with a wheeled vehicle for enhancing the starting ability of the vehicle comprising:

a wedge-shaped ramp having a ground-contacting base including a substantially rectangular frame having opposed, spaced apart sides and opposed, spaced apart ends, and having spaced cross pieces between the sides thereof forming plural, box-like regions within the frame, and which further includes plural base pads mounted to said frame in said regions and an inclined vehicle-support surface extending upward from one end of said base;

connecting means for connecting said ramp to the vehicle and for positioning the vehicle on said ramp at a predetermined location on said vehicle-support surface; and direction orienting means connected to said ramp for providing ramp directional control after the vehicle is clear of said ramp.

2. The staring ramp assembly of claim 1 wherein said base pads includes a spring-biased mounting and are spring-biased thereby to a position where said pads extend below the level of the base thereby providing a skid surface when the vehicle is clear of said ramp, said pads being shiftable upward relative to said frame when the vehicle is on the ramp, thereby providing slip-resistant contact between said frame and the ground.

3. The starting ramp assembly of claim 1 wherein said connecting means includes a length of chain connected at the other end of said ramp and said direction orienting means includes a coil spring extending between a side of said ramp and said chain, said coil spring being constructed and arranged to direct said chain along said side of said ramp as the vehicle clears the ramp, thereby causing end-for-end rotation of said ramp.

4. The starting ramp assembly of claim 1 wherein said base includes a catch tray for retaining, temporarily, water in which the assembly is immersed.

5. A starting ramp assembly for use with a wheeled vehicle for enhancing the starting ability of the vehicle and for moving with the vehicle in a forward direction after the vehicle is clear thereof comprising:

a wedge-shaped ramp including a generally rectangular ground-contacting base having opposed, spaced apart sides and opposed, spaced apart ends, a plate having spaced apart sides fixed to the upper surface thereof and opposed, spaced apart ends and spaced cross pieces secured to the lower surface of said plate extending between the sides thereof forming plural, box-like regions within the frame, and which further includes plural base pads mounted to said frame in said regions, each pad having a generally rectangular form, an upper surface and a lower surface, an inclined vehicle-support surface extending upward from one end of said base, and an upright member extending between the other end of said base and said vehicle-support surface;

connecting means for connecting said ramp to the vehicle and for retarding rearward movement of the vehicle on said ramp, said connecting means including a length of chain connected at the other end of said ramp; and direction orienting means connected to said ramp for providing ramp directional control after the vehicle is clear of said ramp, said orienting means including a coil spring extending between a side of said ramp and said chain, said coil spring being constructed and arranged to direct said chain along said side of said ramp as the vehicle clears the ramp, thereby causing end-for-end rotation of said ramp on said base.

6. The starting ramp assembly of claim 5 which includes plural, spring-biased mountings for each base pads, said pads being spring-biased thereby to a position where each pad extends below the level of the base thereby providing a skid surface when the vehicle is clear of said ramp, said pads being shiftable upward relative to said frame when the vehicle is on the ramp, thereby providing slip-resistant contact between said frame and the ground.

7. The starting ramp assembly of claim 6 wherein each mounting includes a threaded shaft extending to said pad and through said frame, said mounting further including a coil spring surrounding a portion of said shaft between the top surface of said pad and the lower surface of said frame.

8. The starting ramp assembly of claim 5 wherein said pads are mounted on said frame such that the lower surface of each pad has an upward slope toward the other end of said ramp.

9. The starting ramp assembly of claim 5 wherein said plate and said sides form a catch tray for retaining, temporarily, water in which the ramp assembly is immersed.

10. A starting ramp assembly for use with a wheeled vehicle for enhancing the starting ability of the vehicle and for moving with the vehicle in a forward direction after the vehicle is clear thereof comprising:

a wedge-shaped ramp having a ground-contacting base, said base including a generally rectangular frame having opposed, spaced apart sides and opposed, spaced apart ends, and having spaced cross pieces extending between the sides thereof forming plural, box-like regions within the frame, and which further includes plural base pads mounted to said frame in said regions, plural spring-biased mountings for each pad, said pads and being spring-biased thereby to a position where said pads extend below the level of the base providing a skid surface when the vehicle is clear of said ramp, said pads being shiftable upward relative to said frame when the vehicle is on the ramp, thereby providing slip-resistant contact between said frame and the ground;

an inclined vehicle-support surface extending upward from one end of said base; and an upright member extending between the other end of said base and said vehicle-support surface;

connecting means for connecting said ramp to the vehicle and for retarding rearward movement of the vehicle on said ramp; and direction orienting means connected to said ramp for providing ramp directional control after the vehicle is clear of said ramp, thereby causing end-for-end rotation of said ramp allowing said ramp to follow the vehicle in a forward direction of travel.

11. The starting ramp assembly of claim 10 which further includes a generally planar, rectangular plate interposed between said sides and said ends and cross pieces, wherein said plate and said sides form a catch tray for retaining, temporarily, water in which the ramp assembly is immersed.

12. The starting ramp assembly of claim 11 wherein the end of said plate adjacent said upright member extends beyond said other end and has a bore formed therein for attachment of connecting means thereto.

13. The starting ramp assembly of claim 10 wherein said connecting means includes a length of chain connected at the other end of said ramp and said direction orienting means includes a coil spring extending between a side of said ramp and said chain, said coil spring being constructed and arranged to direct said chain along said side of said ramp as the vehicle clears the ramp, thereby causing end-for-end rotation of said ramp.

14. The starting ramp assembly of claim 10 wherein said vehicle support surface of pivotably attached to said base and to said upright member and said upright member is disconnectably attached to said other end of said base thereby allowing selective collapsing of said ramp.

15. The starting ramp assembly of claim 10 wherein said pads are mounted on said frame such that the lower surface of each pad has an upward slope toward the other end of said ramp.

16. The starting ramp assembly of claim 10 wherein each mounting includes a threaded shaft extending to said pad and through said frame, said mounting further including a coil spring surrounding a portion of said shaft between the top surface of said pad and the lower surface of said frame.

17. The starting ramp assembly of claim 16 which includes slots on said frame for receiving said shafts therein for allowing limited longitudinal movement of said shafts relative to said frame.

* * * * *